US006547629B1

(12) United States Patent
Dubois et al.

(10) Patent No.: US 6,547,629 B1
(45) Date of Patent: Apr. 15, 2003

(54) ELECTRONIC TOY AND METHOD OF USING THE SAME

(75) Inventors: David M. Dubois, East Aurora, NY (US); Edward Masiello, II, Newburgh, NY (US); Larry R. Nagode, Hamburg, NY (US); Justin T. Petit, Depew, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/854,855

(22) Filed: May 15, 2001

(51) Int. Cl.[7] ..... A63H 3/28

(52) U.S. Cl. ..... 446/297; 446/397; 446/484

(58) Field of Search ..... 446/297, 175, 446/484, 302, 100, 97, 397; 434/335, 338, 340; 273/447–448, 237–238

(56) References Cited

U.S. PATENT DOCUMENTS

| | | | | |
|---|---|---|---|---|
| 1,654,336 A | | 12/1927 | Lindstrom | |
| 2,614,362 A | | 10/1952 | Zavala | |
| 3,715,540 A | | 2/1973 | Larson | |
| 3,949,517 A | | 4/1976 | Reiner et al. | |
| 4,010,340 A | | 3/1977 | Palmaer | |
| 4,237,647 A | | 12/1980 | Shaw | |
| 4,294,035 A | | 10/1981 | Klein | |
| 4,314,423 A | | 2/1982 | Lipsitz et al. | |
| 4,392,408 A | | 7/1983 | Suzuki | |
| 4,491,325 A | | 1/1985 | Bersheim | |
| 4,604,065 A | * | 8/1986 | Frazer et al. | 434/331 |
| 4,613,139 A | | 9/1986 | Robinson, II | |
| 4,687,457 A | | 8/1987 | Milner | |
| 4,737,134 A | | 4/1988 | Rumsey | |
| 4,767,374 A | | 8/1988 | Yang | |
| 4,820,233 A | | 4/1989 | Weiner | |
| 4,867,726 A | | 9/1989 | Fujimaki | |
| 4,941,857 A | | 7/1990 | Fujimaki | |
| 4,993,983 A | | 2/1991 | Kurita et al. | |
| 5,127,869 A | | 7/1992 | Hanzawa | |
| 5,190,285 A | * | 3/1993 | Levy et al. | 273/85 G |

(List continued on next page.)

FOREIGN PATENT DOCUMENTS

| | | |
|---|---|---|
| GB | 2 045 098 A | 10/1980 |
| GB | 2 119 267 A | 11/1983 |
| GB | 2 185 141 A | 7/1987 |
| GB | 2 275 207 A | 8/1994 |
| GB | 2 290 240 A | 12/1995 |

*Primary Examiner*—Derris H. Banks
*Assistant Examiner*—Jamila Williams
(74) *Attorney, Agent, or Firm*—Cooley Godward LLP

(57) ABSTRACT

An electronic toy that can be activated so as to entertain and educate a child is disclosed. The electronic toy includes a toy figure and/or an interactive member. In one embodiment, the toy figure includes a body and at least one actuator mechanism. The electronic toy can generate an audio output in response to activation by a user of an actuator mechanism. In one embodiment, the toy figure includes multiple parts that can be moved relative to each other. In one embodiment, the electronic toy includes two actuator mechanisms that can be activated by a user at any time. The electronic toy can generate audio outputs, including speech and sound effects, in response to the activation by a user of the actuator mechanisms. In one embodiment, the electronic toy can generate speech in response to the activation of a first actuator mechanism and sound effects in response to the activation of a second actuator mechanism.

18 Claims, 5 Drawing Sheets

U.S. PATENT DOCUMENTS 5,290,198 A 3/1994 Nakayama
5,330,380 A 7/1994 McDarren et al.
5,349,129 A 9/1994 Wisniewski et al.
5,466,181 A * 11/1995 Bennett et al. ..... 446/297
5,607,336 A 3/1997 Lebensfeld et al.
5,651,716 A 7/1997 Mowrer et al.
5,768,223 A 6/1998 Li et al.
5,906,369 A * 5/1999 Brennan et al. ..... 273/238
5,973,420 A 10/1999 Kaiserman et al.
6,089,943 A 7/2000 Lo
6,227,931 B1 5/2001 Shackelford
6,257,948 B1 * 7/2001 Silva ..... 446/100
6,330,427 B1 * 12/2001 Tabachnik ..... 434/317

* cited by examiner

ELECTRONIC TOY AND METHOD OF USING THE SAME

BACKGROUND OF THE INVENTION

This invention relates generally to an electronic toy, and in particular, to an electronic toy that generates audio outputs, such as speech and sound effects.

Children have a particular fascination with animals, for example, the sounds that animals make. The need exists for an electronic toy that can be easily activated to generate audio outputs to entertain and educate a user.

SUMMARY OF THE INVENTION

Generally, the embodiments of the present invention provide an electronic toy that may be activated so as to entertain and educate a user.

DETAILED DESCRIPTION OF THE INVENTION

An electronic device or toy includes a toy figure and an interactive member. In one embodiment, the toy figure includes a body and at least one actuator mechanism. The electronic toy can generate an audio output in response to activation by a user of an actuator mechanism. In one embodiment, the toy figure includes multiple parts that can be moved relative to each other.

In the illustrated embodiment, the electronic toy includes two body parts that can be moved relative to each other. The electronic toy includes a base and a movable member. The movable member can be disposed in a first position and a second position. When the movable member is in the first position, an actuator mechanism on the electronic toy is activated. When the movable member is in the second position, the actuator mechanism is not activated.

In one embodiment, the electronic toy includes two actuator mechanisms that can be activated by a user at any time.

The electronic toy can generate audio outputs, including speech and sound effects, in response to the activation by a user of the actuator mechanisms. In one embodiment, the electronic toy can generate speech in response to the activation of a first actuator mechanism and sound effects in response to the activation of a second actuator mechanism.

Figure 1:
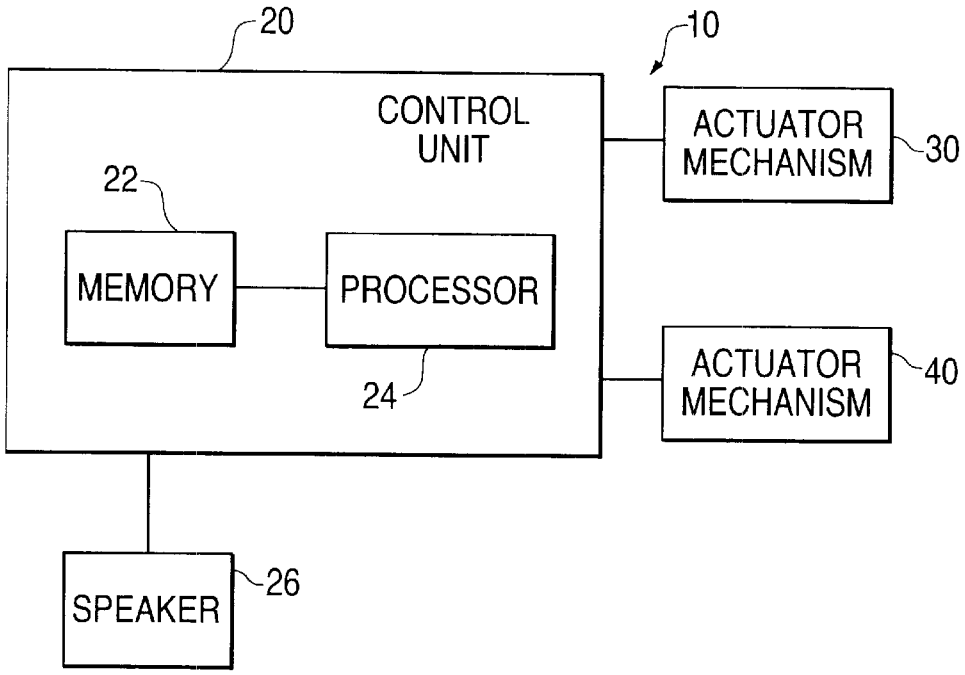
FIG. 1 illustrates a schematic view of the operational components of an electronic toy according to an embodiment of the invention.

An electronic toy according to an embodiment of the invention is illustrated in FIG. 1. FIG. 1 illustrates a schematic view of some of the functional components of the electronic toy 10.

In the illustrated embodiment, the electronic toy 10 includes a control unit 20 and actuators or actuator mechanisms 30 and 40. The actuators 30 and 40 are connected to the control unit 20. In the illustrated embodiment, the actuators 30 and 40 are connected to the control unit 20 by wiring. The control unit 20 and wires form part of an audio output generating circuit. In other embodiments, the actuators can be connected to the control unit 20 using any wired or wireless connections. For example, the electronic toy may include an infra red, radio frequency, or ultrasonic receiver and transmitter, which can be used to control the electronic toy remotely.

In the illustrated embodiment, the control unit 20 includes a memory 22 in which different types of pre-recorded audio outputs, such as speech phrases and sound effects, are stored. One type of audio output is speech. For example, different phrases containing facts about the electronic toy may be stored in memory 22. In one embodiment, the electronic toy includes a toy figure that may resemble an animal, a person, a character, or other object. The speech output from memory 22 may include facts about the particular animal, person, or character that the toy figure resembles. For example, if the toy figure resembles a tiger, the speech output may include facts about tigers (e.g., the size of tigers, the behavior of tigers, etc.).

Another type of audio output is sound effects. In one embodiment, if the toy figure resembles an animal, sound effects similar to those that the animal makes are stored in memory 22. For example, if the toy figure resembled a tiger, then several sounds associated with a tiger, such as different roars, are stored in memory 22.

The memory 22 can be any type of conventional memory, such as a disk drive, cartridge, or solid state memory. In the illustrated embodiment, the audio outputs are pre-recorded in the memory.

The control unit 20 also includes a processor 24 that can access data stored in memory 22. The processor 24 can be any type of conventional processor, such as a conventional integrated circuit. The electronic toy 10 also includes a power supply (not shown).

The electronic toy 10 includes a speaker (or other suitable audio transducer) 26 through which the audio outputs can be played. The speaker 26 is connected to the control unit 20 via wiring.

Figure 2:
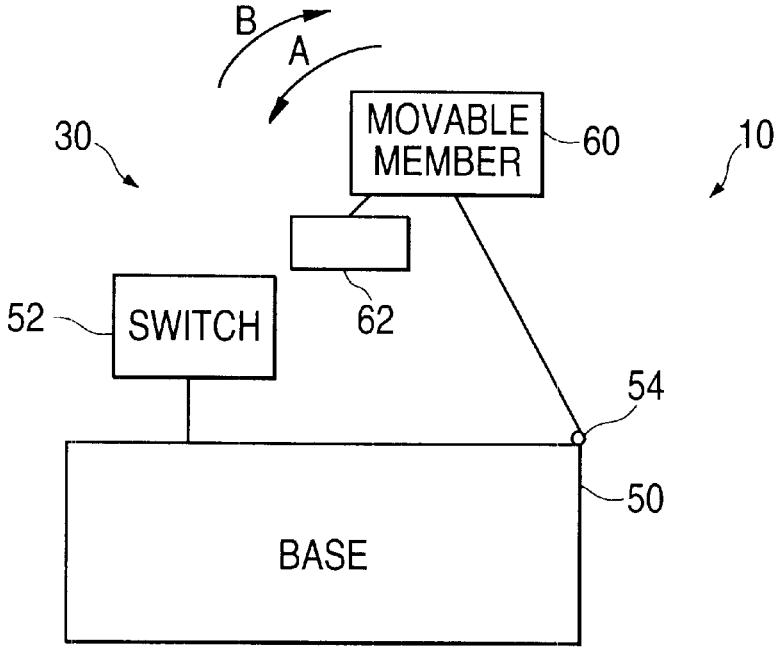
FIG. 2 illustrates a schematic view of an embodiment of an actuator mechanism of the electronic toy of FIG. 1.

An implementation of the electronic toy is illustrated in FIG. 2. In the illustrated embodiment, the electronic toy 10 includes a base 50 and a movable member 60. The movable member 60 is movably coupled to the base 50. In one embodiment, the movable member 60 is pivotally coupled to the base 50 at pivot 54. In another embodiment, the movable member 60 is slidably coupled to the base 50.

Figure 3:
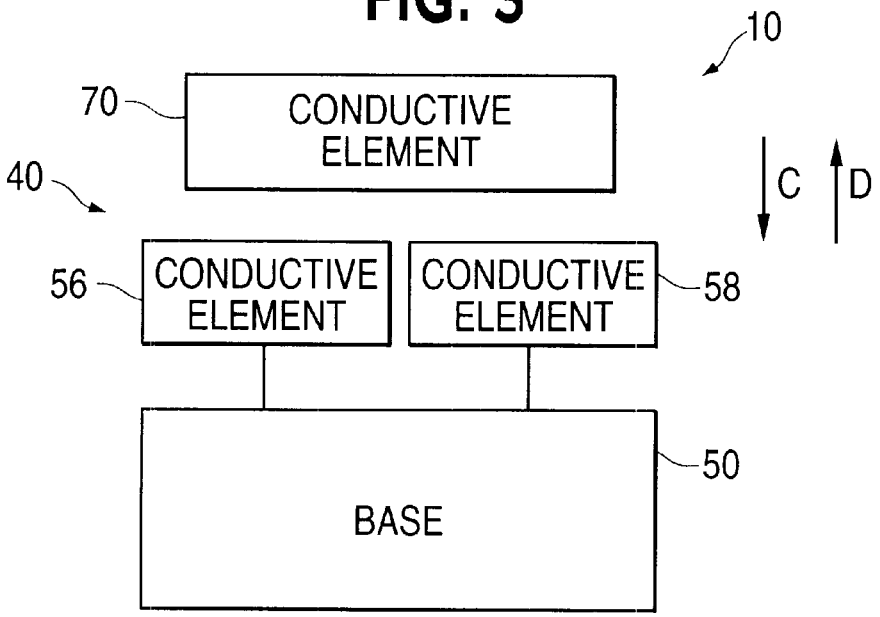
FIG. 3 illustrates a schematic view of an alternative embodiment of an actuator mechanism of the electronic toy of FIG. 1.

Exemplary embodiments of actuator mechanisms are illustrated in FIGS. 2 and 3. In the illustrated embodiment (see FIG. 2), actuator mechanism 30 includes a switch 52 coupled to the base 50 and a cam member 62 coupled to movable member 60. Cam member 62 is a small piece of conductive material, such as metal, that is coupled to the movable member 60 by welding or any other conventional method.

In one embodiment, switch 52 is a push button type switch. Switch 52 may be any conventional switch structure that generates a signal in response to the relative movement of two parts (e.g., a leaf spring type switch, a reed switch, etc.).

As shown in FIG. 2, the cam member 62 is mounted for movement relative to switch 52. Cam member 62 is aligned with the switch 52. When the user moves the movable member 60 along the direction of arrow "A" in FIG. 2, cam member 62 engages switch 52 and the actuator mechanism 30 is activated. The electronic toy 10 generates an audio output upon the activation of the actuator mechanism 30. When the user moves the movable member 60 along the direction of arrow "B" in FIG. 2, switch 52 is opened and the actuator mechanism 30 is not activated. Note that in one embodiment, movable member 60 is biased in direction "B" by a spring, living hinge, or other biasing element(s) (none of which are shown).

Another embodiment of an actuator mechanism according to an embodiment of the invention is illustrated in FIG. 3. Actuator mechanism 40 includes conductive elements 56 and 58. In one embodiment, conductive elements 56 and 58 are small pieces of conductive material, such as metal, that form a switch that is closed when the elements 56 and 58 are bridged by another conductive element, such as conductive element 70. While the actuator mechanism 40 is illustrated with only two conductive elements, the actuator mechanism may include any number of conductive elements.

In the illustrated embodiment, when conductive element 70 is moved along the direction of arrow "C" and placed into contact with both conductive elements 56 and 58 (see FIG. 3), the actuator mechanism 40 is activated. The electronic toy 10 generates an audio output upon the activation of the actuator mechanism 40. When the user moves the conductive element 70 along the direction of arrow "D" in FIG. 3, the actuator mechanism 40 is not activated.

Any type of switch that can be closed based on the position of the movable member relative to the base can be used. While switch 52 and contacts 56 and 58 are illustrated on the base 50 and cam member 62 is illustrated on the movable member 60, the positions of any one or more of the contacts, cam member, and switch may be reversed. For example, cam member 62 can be coupled to the base 50 and switch 52 can be coupled to the movable member 60.

Figure 4:
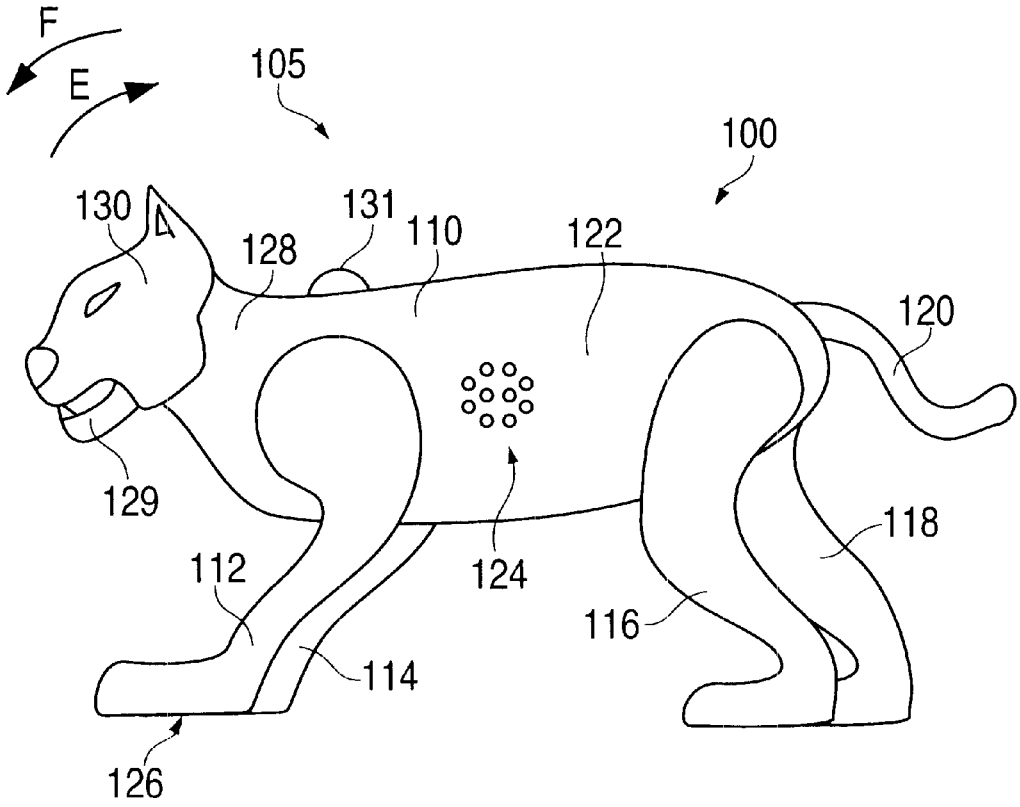
FIG. 4 illustrates a side view of an embodiment of a toy figure embodying the principles of the invention.

An implementation of an electronic toy embodying the principles of the present invention is illustrated in FIGS. 4–8. In the illustrated embodiment, the electronic toy 100 includes a toy figure 105 as illustrated in FIG. 4. In one embodiment, the toy figure 105 resembles a tiger. In other embodiments, the toy figure 105 may resemble any animal (e.g., a shark, a gorilla, an elephant, etc.), character, or person.

In the illustrated embodiment, the toy figure 105 includes a body 110 and several appendages 112, 114, 116, 118, and 120. As shown in FIG. 4, appendages 112, 114, 116, and 118 resemble limbs and appendage 120 resembles a tail of the toy figure 105. The body 110 and the appendages are formed of a non-conductive material, such as plastic.

In the illustrated embodiment, each of the appendages 112, 114, 116, 118, and 120 is pivotally coupled to the body 110. The appendages may be coupled to the body 110 using any suitable fastener (e.g., a rivet, bolt, etc.) or any suitable joint (e.g., a ball and socket connection). The toy figure may include any number of appendages, of which any number may be movable relative to the body (i.e., articulable appendages).

The body 110 includes a side surface 122 with openings 124 located proximate to a speaker (not shown) disposed inside the body 110. Audio output from the speaker passes through the openings 124 so the user may hear the generated output. The location of the openings 124 may vary depending on the location of the speaker within in the body 110.

Figure 5:
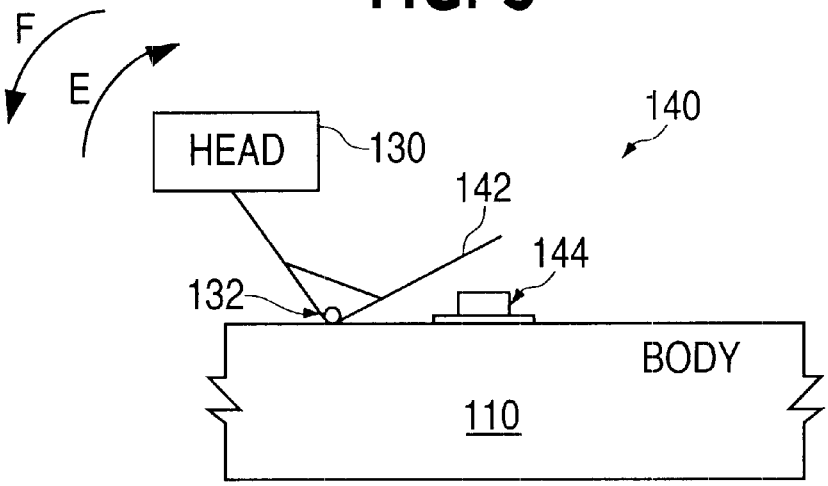
FIG. 5 illustrates a schematic view of an embodiment of some components of the toy figure of FIG. 4.

In one embodiment (see FIG. 4), the body 110 includes an extension or neck portion 128. A lower jaw 129 is formed as part of extension 128. The toy figure 105 also includes a head 130 that is pivotally coupled to the body 110 at pivot 132 as illustrated in FIG. 5. The head 130 moves relative to the lower jaw 129 and extension 128.

As the head 130 moves along the direction of arrow "E", the distance between the head 130 and the lower jaw 129 increases, thereby creating the appearance of the toy figure 105 opening its mouth. As the head 130 moves along the direction of arrow "F", the toy figure 105 appears to be closing its mouth.

In one embodiment, the toy figure 105 includes a button 131 that is coupled to head 130 as illustrated in FIG. 4. The button 131 may extend through an opening (not shown) in the upper surface of the toy figure 105. The user may push button 131 or manually pivot the head 130 in the direction of arrow "E" to move the head 130.

As illustrated in the schematic view of FIG. 5, the toy figure 105 includes an actuator mechanism 140 disposed within the body 110. The actuator mechanism 140 includes a cam member 142 and a switch 144. In one embodiment, the cam member 142 is coupled to the head 130.

As the head 130 pivots along the direction of arrow "E", the cam member 142 engages and closes the switch 144. When switch 144 is closed, the actuator mechanism 140 is activated and a signal is sent to the control unit 20. The processor 24 accesses the appropriate output stored in memory 22 and the electronic toy 100 plays the output. Thus, in one embodiment, a user may manually pivot the head 130 or press button 131 to activate actuator 140.

In the illustrated embodiment, the toy figure 105 generates a sound effect upon the activation of actuator mechanism 140. For example, if the toy figure 105 resembles a lion, a "roar" is heard when the actuator mechanism 140 is activated.

When the actuator mechanism 140 is activated again, the control unit 20 advances to the next sound effect in memory 22, which is played through speaker 26. The toy 100 continuously loops through the sound effects in memory 22 as the actuator mechanism 140 is repeatedly activated. In an alternative embodiment, the toy 100 randomly selects and plays sounds effects in memory 22 as the actuator mechanism 140 is repeatedly activated.

The arrangement of the movable member and body 10 can vary and may depend on what the toy figure 105 resembles. For example, the movable member of the toy figure 105 may be a body part other than the head. In one embodiment, the toy figure may resemble a shark and the movable member may be the shark's fin. When the fin is moved a sufficient distance to close an internal switch in the body, sound effects associated with the shark are played.

Figure 6:
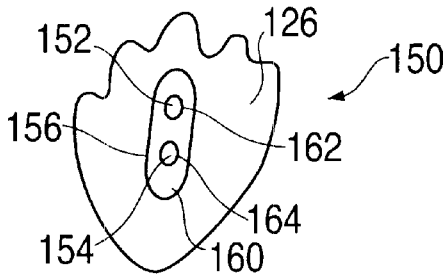
FIG. 6 illustrates a bottom view of an embodiment of an appendage of the toy figure of FIG. 4.
Figure 7:
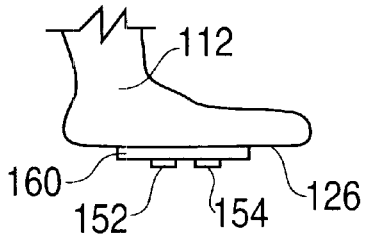
FIG. 7 illustrates a side view of the appendage of FIG. 6.

In the illustrated embodiment, the electronic toy 100 includes an actuator mechanism 150 that includes conductive elements or contact members 152 and 154 as illustrated in FIGS. 6 and 7. In one embodiment, the conductive elements 152 and 154 are disposed on an outer surface 126 of the body 110. For example, conductive elements 152 and 154 are disposed on the bottom surface of appendage 112.

Conductive elements 152 and 154 are connected to the control unit 20 via wires (not shown) that run through appendage 112. While two contact members with circular shapes are illustrated, any number of contact members with any shape, including (but not limited to) geometric configurations, etc., can be used in the actuator mechanism.

In one embodiment (see FIG. 6), the outer surface 126 includes an opening 156. A support 160 is disposed in the opening 156. In the illustrated embodiment, support 160 includes two openings 162 and 164 and is a piece of non-conductive material, such as plastic. Support 160 maintains conductive elements 152 and 154 in a spaced and insulated relationship.

In an alternative embodiment, the toy figure 105 does not include a support 160. Conductive elements 152 and 154 can be disposed directly in two openings (not shown) formed in the outer surface 126 such that the body 110 insulates the conductive elements 152 and 154 from each other.

Figure 8:
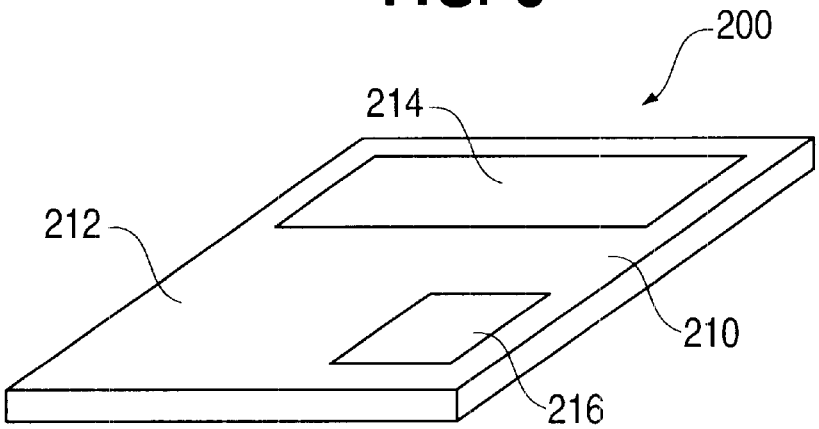
FIG. 8 illustrates a perspective view of an embodiment of an interactive member embodying the principles of the invention.
Figure 9:
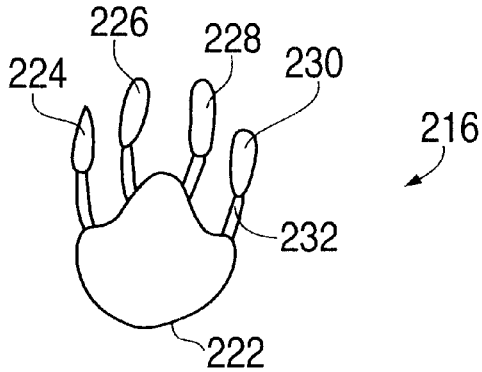
FIG. 9 illustrates a top view of an embodiment of a conductive member of the interactive member of FIG. 8.

In the illustrated embodiment, the electronic toy 100 includes an interactive member. An embodiment of an interactive member is illustrated in FIGS. 8 and 9. Interactive member 200 includes a body 210 with an upper surface 212 that has an information portion 214 and a conductive portion 216.

In one embodiment, the information portion 214 is a non-conductive portion that includes indicium or indicia associated with the particular toy figure. Some examples of indicia that may be included on information portion 214 include: text, colors, photographs, pictorial representations, patterns, and lenticular videos. For example, if the toy figure 105 resembles a tiger, the information portion 214 may include a pictorial representation of a tiger.

The upper surface 212 around the information portion 214 and conductive portion 216 may include a combination of colors or a pattern that is associated with a particular toy figure. For example, if the toy figure resembles a tiger, several orange and black stripes may be distributed on upper surface 212.

In the illustrated embodiment, the interactive member 200 is a thin, sheet-like card member. The interactive member 200 is formed of a non-conductive material, such as plastic. In one embodiment, the interactive member 200 is approximately the same size as a trading card (e.g., sports cards, hobby cards, etc.).

An embodiment of a conductive portion of the interactive member is illustrated in FIG. 9. In one embodiment, conductive portion 216 is a unitary piece of material. Conductive portion 216 is used to bridge conductive elements 152 and 154 disposed on the toy figure 105. Since the conductive portion 216 is a unitary piece of material, conductive elements 152 and 154 are bridged when they contact any part of the conductive portion 216.

In the illustrated embodiment, the conductive portion 216 resembles a paw print of an animal. Conductive portion 216 includes pad portion 222 and finger/toe portions 224, 226, 228, and 230. The pad portion 222 and the finger/toe portions are connected via connector portions 232 as illustrated in FIG. 9. In the illustrated embodiment, the pad portion 222 and the finger/toe portions extend through openings in the upper surface 212 of the interactive member body 210 and connector portions 232 are disposed beneath part of the upper surface 212.

Figure 10:
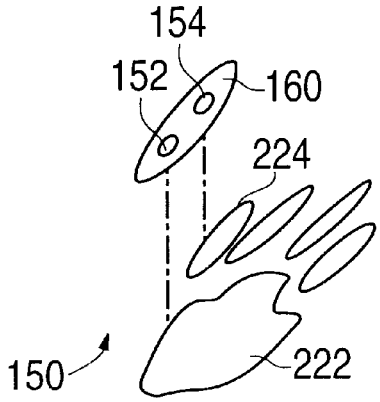
FIG. 10 illustrates an exploded perspective view of the operative relationship of the conductive elements on the toy figure and the conductive member of FIG. 9 according to the principles of the invention.

Now the operation of the actuator mechanism 150 is described. The user moves the toy figure 105 proximate to the interactive member 200 so that the conductive elements 152 and 154 are aligned with the conductive portion 216 on the interactive member 200 as illustrated in FIG. 10.

When conductive elements 152 and 154 are in contact with the conductive portion 216 simultaneously, the elements 152 and 154 are bridged and the actuator mechanism 150 is activated. As illustrated in FIG. 10, conductive elements 152 and 154 can contact pad portion 222 and finger/toe portion 224, respectively, to activate the actuator mechanism 150.

In the illustrated embodiment, the toy figure 105 generates speech, such as a phrase, upon the activation of actuator mechanism 150. Several phrases corresponding to the toy figure 105 are recorded and stored in the memory 22. For example, if the toy figure 105 resembles a lion, several facts about lions are stored in memory 22. When the actuator mechanism 150 is activated, one of the stored phrases is played.

When the actuator mechanism 150 is activated again, the control unit 20 advances to the next phrase in memory 22, which is played through speaker 26. The toy 100 continuously loops through the phrases in memory 22 as the actuator mechanism 150 is subsequently activated. In an alternative embodiment, the toy 100 randomly selects and plays phrases in memory 22 as the actuator mechanism 150 is subsequently activated. In one embodiment, four different phrases are stored in memory 22. However, any number of phrases may be stored.

Many possible variations on the particular embodiments described above would be consistent with the principles of the invention. Several additional variations are described below.

The configuration of the conductive portion on the interactive member may vary. The shape of the conductive portion may resemble the shape of a paw print from any animal that the toy figure resembles. Also, the conductive portion may be any other shape (e.g., a geometric shape, a letter, the shape of an animal, etc.).

The interactive member may be any size and configuration as long as it includes a conductive portion.

The electronic toy may generate output in addition to audio output in response to a user input. For example, the electronic toy may include lights (or any other visual output devices) and generate visual output in addition to an audio output.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

What is claimed is:

1. An electronic toy comprising:

a toy figure including a body, a first actuator mechanism disposed on said body, a second actuator mechanism disposed on said body, and an audio output generating circuit connected to said first actuator mechanism, said first actuator mechanism including first and second contact members, said second actuator mechanism including a switch selectively disposable between a first position and a second position; and an interactive member including a conductive portion and a non-conductive portion, said interactive member having an indicium disposed thereon, said indicium being associated with said toy figure, said audio output generating circuit generating a first audio output when said first and second contact members engage said conductive portion, and said audio output generating circuit generating a second audio output when said switch is moved to its first position.

2. The electronic toy of claim 1 wherein said toy figure resembles an animal and said indicium includes a pictorial representation of said animal.

3. The electronic toy of claim 1 wherein said toy figure resembles an animal and said indicium includes text associated with said animal.

4. The electronic toy of claim 1 wherein said conductive portion has a configuration, said configuration being associated with said toy figure.

5. The electronic toy of claim 4 wherein said toy figure resembles an animal that includes a paw, said first and second contact members are disposed on said paw, and said conductive portion is configured in the shape of said paw.

6. The electronic toy of claim 1 wherein said first audio output includes one of speech and sound effects.

7. The electronic toy of claim 1 wherein said interactive member is a card.

8. A method of generating an audio output from a toy, the toy including a toy figure and an interactive member, the toy figure including a body, a first actuator mechanism disposed on the body, a second actuator mechanism disposed on the body, and an audio output generating circuit disposed within the body and connected to the first actuator mechanism, the first actuator mechanism including first and second contact members, the second actuator mechanism including a switch selectively disposable between a first position and a second position, the interactive member including a conductive portion and a non-conductive portion, the interactive member having indicium disposed thereon, the indicium being associated with the toy figure, the audio output generating circuit generating an audio output when the first and second contact members engage the conductive portion, the method comprising:

engaging the first and second contact members on the toy figure with the conductive portion on the interactive member to generate a first audio output; and actuating the second actuator mechanism to generate a second audio output.

9. The method of claim 8 wherein the toy figure resembles an animal including a paw, the first and second contact members are disposed on the paw, the conductive portion is configured in the shape of the paw, and said step of engaging the first and second contact members includes engaging the paw on the conductive portion.

10. A toy comprising:

a toy figure including a body including:

a first actuator mechanism disposed on said body, said first actuator mechanism including first and second contact members;

a second actuator mechanism disposed on said body;

an audio output generating circuit disposed within said body and connected to said first actuator mechanism and said second actuator mechanism, said audio output generating circuit generating a first audio output in response to the activation of said first actuator mechanism and a second audio output in response to the activation of said second actuator mechanism; and an interactive card including a conductive portion and a non-conductive portion, said non-conductive portion including an indicium associated with said toy figure, said first actuator mechanism being activated when said first and second contact members engage said conductive portion.

11. The toy of claim 10 wherein said toy figure resembles an animal including a paw, said indicium is a representation of said animal, said first and second contact members are disposed on said paw, and said conductive portion is configured in the shape of said paw.

12. The toy of claim 11 wherein said second actuator mechanism includes a switch selectively disposable between a first position and a second position, said audio output generating circuit generates said second audio output when said switch is moved to its first position, and said first and second audio outputs include one of speech and sound effects.

13. A method of generating an audio output from a toy, the toy having a toy figure including a body and a movable member coupled thereto, the method comprising:

disposing a card including an upper surface having a conductive portion and an indicium disposed thereon in a confronting relation to a user; and placing the toy figure on the card so that the conductive portion bridges conductive elements disposed on the toy figure, thereby activating an audio output generating circuit in the toy figure; and moving the movable member to activate the audio output generating circuit in the toy figure.

14. A combination of an interactive card and a toy figure, said interactive card comprising:

an information portion, said information portion including indicium disposed thereon; and a conductive portion adapted to be used with a toy figure that generates an output upon contact with said card; and said toy figure resembling an animal that includes a paw, said toy figure including first and second contact members disposed on said paw.

15. The combination of claim 14 wherein said indicium includes a pictorial representation of said toy figure.

16. The combination of claim 14 wherein said indicium includes text associated with said toy figure and said conductive portion has a configuration, said configuration being associated with said toy figure.

17. The combination of claim 14, wherein said conductive portion is configured in the shape of said paw.

18. An electronic toy comprising:

a toy figure including a body, a first actuator mechanism disposed on said body, and an audio output generating circuit connected to said first actuator mechanism, said first actuator mechanism including first and second contact members, said body resembling an animal; and an interactive member including a conductive portion and a non-conductive portion, said interactive member having an indicium disposed thereon, said indicium being associated with said toy figure and including one of a pictorial representation of said animal and text associated with said animal, said audio output generating circuit generating an audio output when said first and second contact members engage said conductive portion.

* * * * *